US010306728B2

(12) United States Patent
Crosbie et al.

(10) Patent No.: US 10,306,728 B2
(45) Date of Patent: May 28, 2019

(54) COLOR TUNABLE LIGHT WITH ZONE CONTROL

(71) Applicant: NBCUniversal Media, LLC, New York, NY (US)

(72) Inventors: James Crosbie, New York, NY (US); Charles Edwards, Mesa, AZ (US); Richard Pierceall, New York, NY (US)

(73) Assignees: NBCUniversal Media, LLC, New York, NY (US); Cineo Lighting Inc., Half Moon Bay, CA (US)

( * ) Notice: Subject to any disclaimer, the term of this patent is extended or adjusted under 35 U.S.C. 154(b) by 0 days.

(21) Appl. No.: 15/962,795

(22) Filed: Apr. 25, 2018

(65) Prior Publication Data

US 2018/0352629 A1 Dec. 6, 2018

Related U.S. Application Data

(63) Continuation of application No. 15/937,561, filed on Mar. 27, 2018.

(60) Provisional application No. 62/513,133, filed on May 31, 2017.

(51) Int. Cl.

| | |
|---|---|
| ***F21V 19/00*** | (2006.01) |
| ***F21V 21/08*** | (2006.01) |
| ***F21V 21/30*** | (2006.01) |
| ***H05B 33/08*** | (2006.01) |
| ***F21Y 103/10*** | (2016.01) |
| ***F21Y 113/17*** | (2016.01) |
| ***F21Y 115/10*** | (2016.01) |

(52) U.S. Cl.
CPC ..... *H05B 33/0863* (2013.01); *H05B 33/0857* (2013.01); *F21V 19/009* (2013.01); *F21V 21/0816* (2013.01); *F21V 21/30* (2013.01); *F21Y 2103/10* (2016.08); *F21Y 2113/17* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 6,160,359 | A * | 12/2000 | Fleischmann | H05B 37/0254 315/294 |
| 2006/0076908 | A1* | 4/2006 | Morgan | H05B 33/0842 315/312 |
| 2009/0201374 | A1* | 8/2009 | Hung | H04N 9/735 348/187 |
| 2009/0243493 | A1* | 10/2009 | Bergquist | G03B 15/05 315/149 |
| 2012/0206050 | A1* | 8/2012 | Spero | B60Q 1/04 315/152 |

(Continued)

*Primary Examiner* — Crystal L Hammond
(74) *Attorney, Agent, or Firm* — Fletcher Yoder, P.C.

(57) ABSTRACT

A lighting system and method features full gamut color and white color correlated temperature (CCT) control of independently controlled zones. Each zone may be tuned to any color and/or white CCT. The result is a lighting system and method with a light-emitting face having zones of different colors and intensities that may be independently controlled in real time. The lighting system and method enables improved lighting effects for film, television, and still photography as compared to traditional panel lights that are uniform in color over the entire emission surface.

20 Claims, 9 Drawing Sheets

(56) References Cited

U.S. PATENT DOCUMENTS

2013/0176723 A1* 7/2013 Yang ..... F21K 9/64
362/231
2013/0214698 A1* 8/2013 Aliakseyeu ..... G06F 3/011
315/292

* cited by examiner

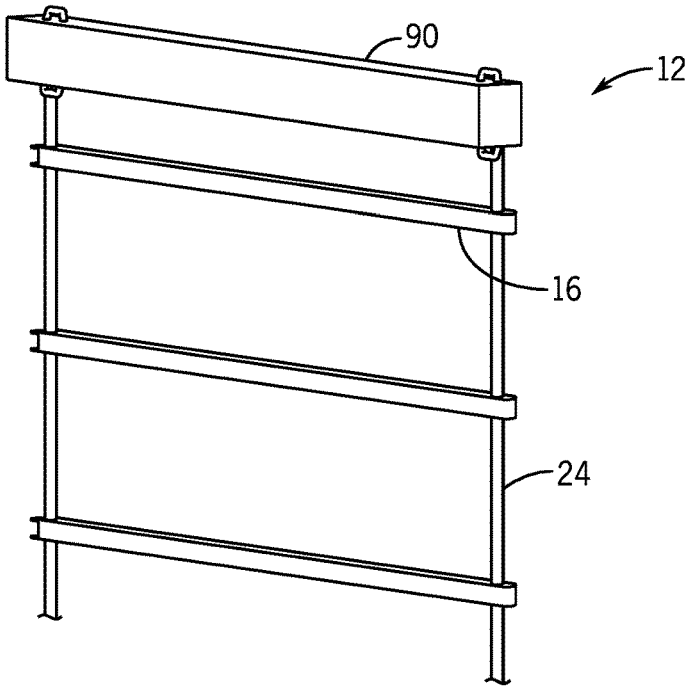
FIG. 3
FIG. 4
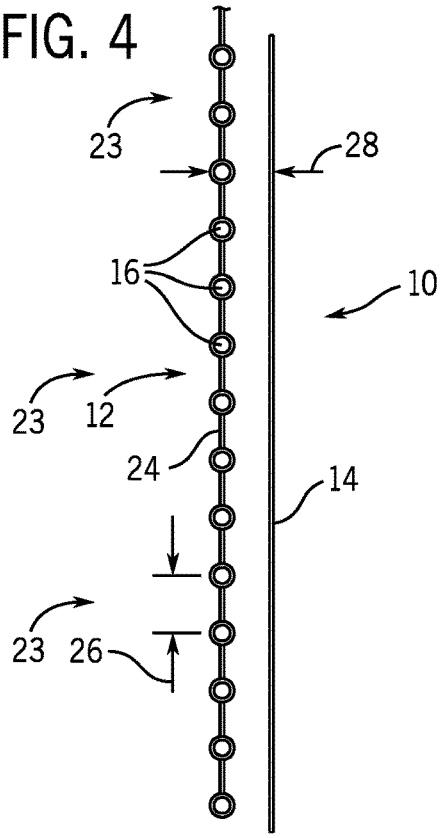
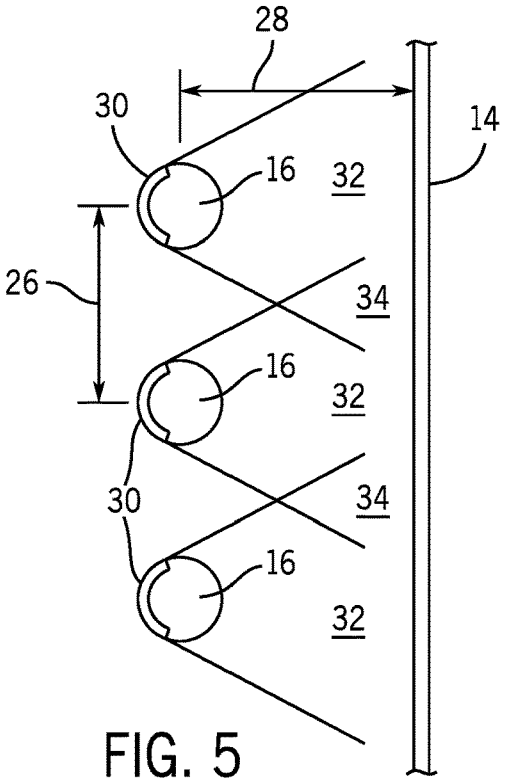
FIG. 5

COLOR TUNABLE LIGHT WITH ZONE CONTROL

CROSS REFERENCE TO RELATED APPLICATIONS

This application is a Continuation of U.S. Non Provisional patent application Ser. No. 15/937,561, entitled COLOR TUNABLE LIGHT WITH ZONE CONTROL, filed Mar. 27, 2018, and U.S. Provisional Patent Application No. 62/513,133, entitled METHOD AND APPARATUS FOR A COLOR TUNABLE LIGHT WITH ZONE CONTROL, filed May 31, 2017, which are herein incorporated by reference.

BACKGROUND

The present invention generally relates to lighting systems, and more particularly to lighting systems with zonal color control.

In the field of lighting systems, particularly those used for theater, television, film, and other sets, trade shows, building and outdoor displays, and the like, solid-state light-emitting diode ("LED") lighting is rapidly being adopted. The low power consumption and digital control of LED's make them ideal for motion picture and television production as well as still photography. Additionally, red, blue, and green ("RGB") color schemes and tunable correlated color temperature ("CCT") are common features in LED lighting fixtures for image capture.

One such lighting system is that of a ladder light, which includes a series of linear LED arrays that are suspended with flexible webbing or rigid supports at specific intervals. This is a low cost, lightweight, and easily portable method for lighting large area graphics, backdrops, and large format transparencies for use in film and television. When rigged, a ladder light is easily suspended or assembled resulting in a field of light that can cover very large areas.

Traditionally, lighting systems have not incorporated control of individual lighting zones. Further, these lighting systems have generally featured monochrome color schemes. Therefore, there is a need for zonal color control of lighting systems that may feature non-monochrome color schemes.

BRIEF DESCRIPTION

The present disclosure relates to zonal control LED lighting systems with adjustable color and white CCT. For example, such lighting systems may include a ladder light with individual LED arrays or a large area lighting fixture using one or more printed circuit boards. A typical ladder light or large area lighting fixture may have tunable arrays of zonal lighting devices. The zonal lighting devices may include zones that may be individually controlled to achieve desired color and white CCT light schemes. Each zone may include one or more light tubes with LED arrays, portions of individual LED arrays, or a combination thereof. For convenience, the disclosure describes the LED arrays arranged along a light tube, but the LED arrays may also be placed on non-tubular structures, such as a rectangular block and other shapes. By including individual control of each zone and a coordinating central controller, lights within the lighting system may achieve new special effects such as cascading color, different intensities over zones within the same fixture, and the addition of motion effects. Rather than a single color generated by a static light fixture, zonal control of a lighting system allows for control of both color and intensity that dramatically increases the capabilities and special effects that can be achieved. Zonal control of the lighting system may be achieved using certain sets of color value inputs. For example, sets of inputs may include a hue, saturation, intensity, and CCT value, or may include a red light value, green light value, blue light value, and CCT value. Each set of inputs may be achieved using Smart RGB Logic, as described below.

DRAWINGS

These and other features, aspects, and advantages of the present invention will become better understood when the following detailed description is read with reference to the accompanying drawings in which like characters represent like parts throughout the drawings, wherein:

FIG. 3 is an illustration of an exemplary adjustable lighting assembly, in accordance with current embodiments;

FIG. 4 is a side view of the lighting system of FIG. 1 illustrating a front panel and a rear lighting assembly, in accordance with current embodiments;

FIG. 5 is a diagrammatical representation of a series light tubes of the lighting system of FIG. 1, illustrating exemplary physical configurations and arrangements for lighting a panel, in accordance with current embodiments;

DETAILED DESCRIPTION

Figure 1:
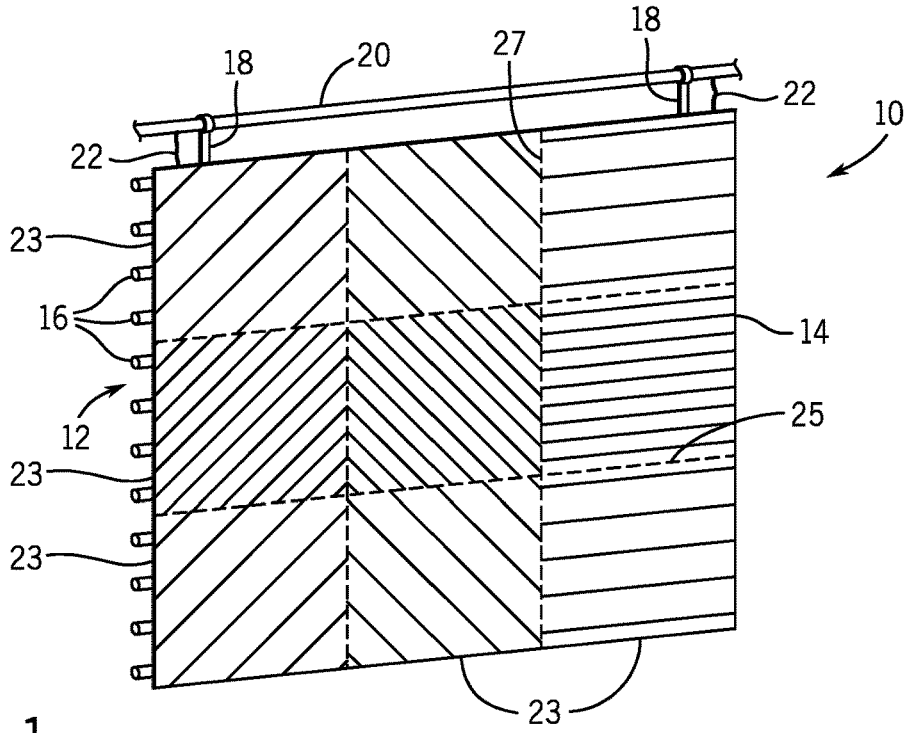
FIG. 1 is an illustration of an exemplary adjustable lighting system, in accordance with current embodiments.

Turning now to the drawings, FIG. 1 illustrates a lighting system 10 that may be suitable for applications such as television and theater sets, film sets, tradeshows, and any one of the range of permanent, semi-permanent, and temporary settings. In the illustrated embodiment, the lighting system 10 includes a lighting assembly 12 that is disposed behind a panel 14. The panel 14 may be transparent or translucent, and may have components, graphics, scenes, or any desired feature drawn, applied, printed, painted, or otherwise disposed on one or both sides thereof. The panel 14 may also be colored or formed to provide any desired effect when light traverses or falls on the panel 14 from the lighting assembly 12. The lighting assembly 12 includes a tunable array of zonal lighting devices. Each zonal lighting device may include one or more light tubes 16 (or another shape such as a rectangular block). In an exemplary embodiment, each zonal lighting device includes two light tubes 16. The lighting assembly 12 of FIG. 1 includes a series of parallel light tubes 16, in this case arranged horizontally behind the panel 14. As discussed in more detail below, each of the light tubes 16 may comprise a series of LED clusters that create and project light towards the panel when powered. The LED clusters within the light tubes 16 may be powered by one or more circuits (e.g., transformers, drive circuits, power converters, etc.) either within the light tubes 16 or external to the light tubes 16. The light tubes 16 may be supported on a flexible support structure indicated generally by reference numeral 18. In the embodiment illustrated in FIG. 1, two flexible support structures 18 extend upwardly from the lighting assembly 12 and may be secured to a mechanical support 20, such as a bar over which the flexible support structures 18 pass. The light tubes 16 may also be supported by rigid supports in combination with or independent of the flexible support structures 18. The light tubes 16 may have rectangular enclosures, cylindrical enclosure, no enclosures (e.g., one or more connected printed circuit boards ("PCB's") with LED clusters), or a combination thereof.

Also illustrated in FIG. 1 are one or more power cables or harnesses 22 that allow for application of power to the light tubes 16. The power cables or harnesses 22 may terminate at a corner of the lighting assembly 12 with a male and/or female connector. For example, at a lower corner of the lighting assembly 12, a male electrical plug may be provided that can be plugged into an outlet, an extension cord, or other power source. In another example, a female receptacle may be provided at a corner of the lighting assembly 12 and coupled to a power cable so that power may be passed to one or more other light assemblies in series or in parallel.

Additionally, the lighting system 10 may include independent zones, indicated by reference numeral 23, that extend along a horizontal width of the lighting system 10, a vertical length of the lighting system 10, or a combination thereof. In the illustrated embodiment of FIG. 1, the zones are defined by dashed lines 25 extending along the horizontal length of the lighting system 10 and dashed lines 27 extending along the vertical length of the lighting system 10, such that the dashed lines form 9 individual zones. In some embodiments, the zones may be defined only by dashed lines 25, and each zone may extend horizontally along the lighting system 10 and may include one or more parallel light tubes 16. In some embodiments, the zones may be defined only by dashed lines 27, and each zone may extend vertically along the lighting system 10 and may include portions of each parallel light tube 16. As described herein, each zone 23 may be independently controlled to display a particular color and white CCT or combination of colors and white CCT's.

Figure 2:
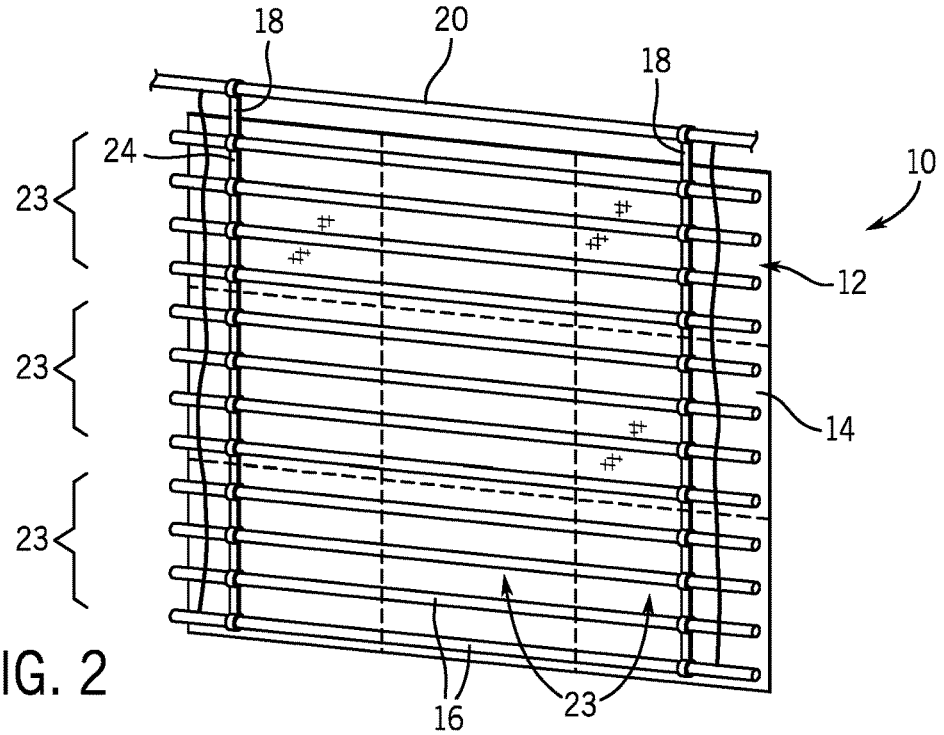
FIG. 2 is a diagram of the lighting system of FIG. 1 from a rear side, in accordance with current embodiments.

The lighting system 10 is illustrated in FIG. 2 from an opposite side of that illustrated in FIG. 1. As noted above, the lighting assembly 12 includes light tubes 16 supported in a parallel arrangement by flexible support structures 18. The panel 14 is disposed adjacent to the lighting assembly 12, and light from the lighting assembly 12 shines onto and/or through the panel 14. In the illustrated embodiment, the flexible support structure 18 includes flexible vertical components that receive and support light tubes. These components may be made of fabric, webbing, or any suitable flexible (i.e., collapsible) material, or a series of segments that can be easily expanded and collapsed. Moreover, these components of the flexible support structure 18 may include pockets that receive and support the light tubes 16, parallel webs with bridge-type members that are disposed under the light tubes 16, slots through which the light tubes 16 pass, or any other suitable support. The lighting assembly 12 may be a hanging structure that hangs from the bar 20 or any suitable support, with the light tubes 16 being positioned in the flexible support structure 18 in the generally parallel arrangement. In some embodiments, one or more weights or other components at an opposite end of the lighting assembly 12 from the bar 20 could also be used to maintain the lighting assembly 12 as taut or stable once deployed.

While the zones 23 defined by the dashed lines 25 in the embodiments of FIGS. 1 and 2 each include 4 light tubes 16, each zone 23 may include more or less light tubes (i.e., each zone 23 may include 1, 2, 3, 4, 5, 6, or more light tubes 16). In some embodiments, the zones 23 may also be dynamically adjusted to include more or less light tubes 16. For example, if the lighting system 10 is used in a backdrop for filming, each zone 23 may include 2 light tubes 16 for a first frame or captured image and may dynamically change to include 4 light tubes 16 for the next frame or captured image.

In some embodiments, the lighting assembly 12 may include rigid support structures 24, as illustrated in FIG. 3. Rigid support structures 24 are configured to maintain a particular configuration and arrangement of the light tubes 16 and the lighting assembly 12. In the illustrated embodiment, the light tubes 16 of the lighting assembly 12 have rectangular enclosures. However, as noted above, each light tube 16 may have a rectangular enclosure, a cylindrical enclosure, no enclosure, or a combination thereof. The lighting assembly 12 may further include a controller 90 disposed at an end of the lighting assembly 12. In some embodiments, the controller 90 may also be disposed at other locations relative to the lighting assembly 12. For example, the controller 90 may be disposed at a middle portion of the lighting assembly 12 or apart from the lighting assembly 12. The light tubes 16 and controller 90 may also be removably coupled to the rigid support structures 24 such that the lighting assembly 12 may be assembled and disassembled as needed.

In some embodiments, the light tubes 16 of the lighting assembly 12 may be configured to emit ultraviolet light, infrared light, and other types of light. For example, the lighting assembly 12 may have light tubes that emit ultraviolet light and/or light tubes that emit infrared light. The various types of light tubes 16 may be used in the lighting assembly 12 to create desired and varied lighting effects. In some embodiments, the light tubes 16 may also include intensifiers disposed at edges of the light tubes 16. The intensifiers may be configured to direct light of a light tube 16 in a particular direction and allow the light tube 16 to achieve a higher intensity of light without using more power.

FIG. 4 is a side view of the light system 10. The lighting system 10 includes the lighting assembly 12 disposed adjacent to the panel 14. In general, as discussed above, the lighting assembly 12 will be placed in back of the panel 14. In some embodiments, however, one or more light assemblies 12 may be placed in front of, between, on top of, or below similar panels, or in various curved configurations with respect to one or more panels 14. The lighting assembly 12 may form a module that may be used singly or with other similar modular light assemblies. In this modular approach, while the light assemblies may be different, they are conveniently identical, having the same number of light tubes and dimensions. In the illustrated embodiment, for example, 12 parallel light tubes 16 are provided at equal spacings as indicated by reference numeral 26 in FIG. 4. Typical spacings may be, for example, between 6 inches and 12 inches. Unlike conventional high-powered spotlights, moreover, the lighting assembly 12 may be placed relatively close to the panel 14 as indicated by dimension 28 in FIG. 4. By way of example, in currently contemplated embodiments, the lighting assembly 12 is placed between 6 inches and 24 inches from the panel 14 (rather than distances on the order of 4 to 8 feet for conventional lighting systems).

FIG. 5 is a detailed illustration of exemplary spacing and illumination by the light tubes 16 of the lighting system 10. While any suitable light tube may be employed, in currently contemplated embodiments, each light tube 16 includes a plurality of clusters of LED chips (not separately shown) with a backing 30. The spacing 26 between the light tubes 16, along with the spacing 28 between the lighting assembly 12 and the panel 14, preferably allows for some degree of overlap between the illuminated regions 32 of each light tube 16. That is, to provide even and consistent lighting of the panel 14, each light tube 16 emits a region of illumination 32 that overlaps an adjacent area 34 as they approach the panel 14. In presently contemplated embodiments, the overlap may comprise the full or nearly full combination of two adjacent light tubes. Additionally, more than two light tubes may contribute to overlapping regions.

Figure 6:
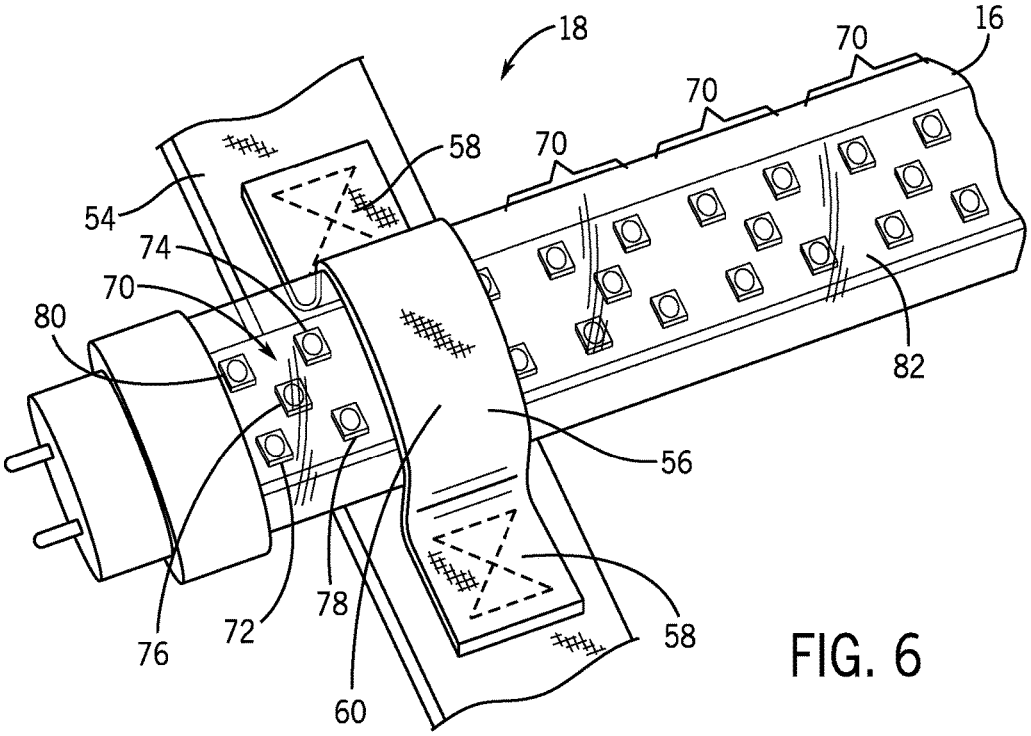
FIG. 6 is a detailed view of an exemplary arrangement for holding and orienting light tubes in a collapsible assembly, in accordance with current embodiments.

FIG. 6 illustrates an example embodiment of a light tube 16 secured to a light tube support structure 18. In presently contemplated configurations, the light tube support structure 18 is made of webbing material with loops to receive and secure the light tubes 16. A loop portion 60 forms an opening 62 through which the light tubes 16 may be inserted. The resulting structure will not only hold the light tubes in place but will provide a secure orientation of the tubes so that the light sources within each tube will remain properly directed as described above. It has been found that, as the system is raised into position, tension on the webbing and loops aids in securely holding and orienting the light tubes.

As noted above, each light tube 16 may include one or more arrays of LED clusters 70. The LED clusters 70 are configured so that light is effectively directed toward a forward face of the light tube 16 and away from the backing 30. In the light tubes used in current embodiments, one or more electrical circuits are provided for converting AC power fed to the power cable to DC power for the individual light chips. LED chips of the LED clusters 70 may be configured to be powered, for example by 12 or 24 vDC, although any suitable power rating may be employed. In an aspect, the light tubes may have a luminous flux rating of approximately 3200 k lumen and a beam angle of approximately 120 degrees.

In presently contemplated configurations, each LED cluster 70 includes LEDs configured to emit white or colored light. As shown, a single array of LED clusters 70 is disposed linearly along a length of the light tube 16. However, additional arrays of LED clusters 70 may be disposed along the length of the light tube (e.g., 2 arrays, 3 arrays, 4 arrays, 5 arrays, 6 arrays, 8 arrays, 10 arrays, 20 arrays, 30 arrays, 40 arrays, 50 arrays, etc.). LED clusters may also be disposed in other configurations. For example, LED clusters may be disposed in a checkerboard pattern along the light tube 16 or in other suitable arrangements to allow for the emission and control of light patterns. In the illustrated embodiment, the LED cluster 70 is disposed on a PCB 82 of the light tube 16. In some embodiments, the LED cluster 70 may be implemented on a single PCB 82 or may be implemented on multiple PCB's 82 of the light tube 16.

Further, in the exemplary embodiment of FIG. 6, each LED cluster 70 includes 5 LED chips. Each LED chip may be configured to emit a particular color and/or white light at a specific CCT (e.g. a CCT of 2700 K or 6500 K). In the illustrated embodiment, each LED cluster 70 includes a 2700 K White LED 72, a 6500 K White LED 74, a Red LED 76, a Green LED 78, and a Blue LED 80. Although five LEDs are illustrated in each LED cluster 70, additional LEDs may be provided in each LED cluster 70 (e.g., three white LEDs along with Red, Green, and Blue LEDs). As described below in reference to FIGS. 16 and 17, each LED cluster with two white LED chips, a red LED chip, a blue LED chip, and a green LED chip may use the Smart RGB mode to accurately create a desired color and white CCT in each zone 23. In some embodiments, phosphor-converted red LED's may be used to enhance color. Further, the blue die and packaging used for the blue and white LED's may share the same package and semiconductor, thereby preventing differential aging and differential thermal performance, which are major challenges when blending LED's that use different semiconductor materials.

Figure 7:
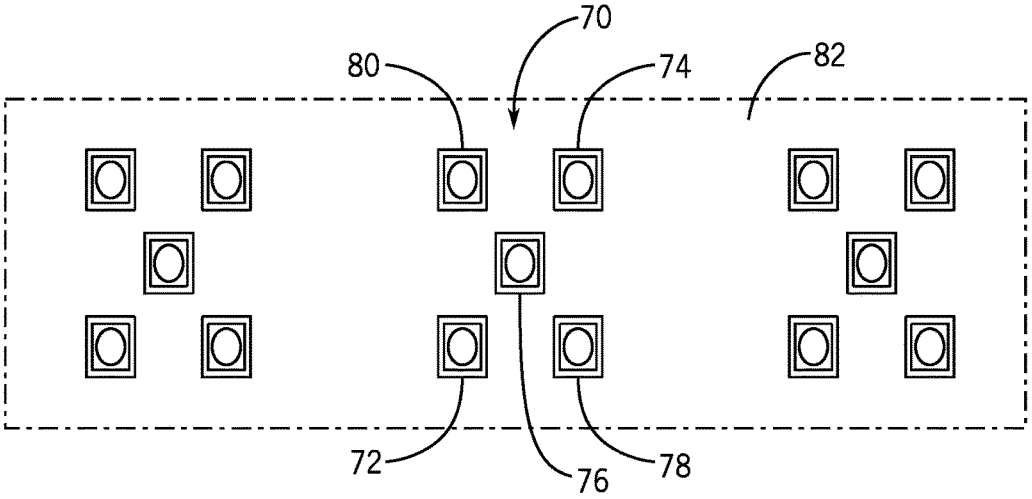
FIG. 7 is an illustration of LED clusters of an adjustable lighting system, in accordance with current embodiments.

FIG. 7 illustrates an exemplary embodiment of LED clusters 70 disposed on a PCB 82. While a single PCB 82 is included in the illustrated embodiment, multiple PCB's 82 may be disposed in or on each light tube 16 such that each LED cluster 70 is printed on a separate PCB. Each LED cluster 70 includes a 2700 K White LED 72, a 6500 K White LED 74, a Red LED 76, a Green LED 78, and a Blue LED 80. Additionally, while the illustrated array of LED clusters 70 includes 3 LED clusters 70, each array of LED clusters may include more than 3 LED clusters. For example, each array of LED clusters may include 10, 20, 30, 40, 50, or more LED clusters.

The inclusion of 2 white LED's (e.g., the 2700 K White LED 72 and the 6500 White LED 74) in each LED cluster 70 of the lighting system 10 create a more accurate white light intensity and CCT compared to traditional lighting systems. The lighting system 10 may be used to create lighting specifically detectable by a camera sensor, as opposed to creating lighting detectable by human vision. As compared to a camera sensor, human vision may be more forgiving because human vision naturally adjusts and perceives various lighting effects. Most lighting systems are developed to provide lighting for human vision and do not need to be as precise. By contrast, because camera sensors are less dynamic, the lighting requirements for a camera sensor may be more stringent. By using two different White LEDs at different color temperatures, the lighting created by the lighting system 10 may simulate what human vision would naturally perceive and may be adjusted to allow a camera sensor to accurately capture the simulated lighting effects. In particular, light emitted by the 2700 K White LED 72 and the 6500 White LED 74 may be precisely adjusted to create a specific white light intensity and CCT that may be accurately detected by a camera sensor and captured by a corresponding camera.

The color and CCT emitted at each LED cluster 70 and each zone 23 may be controlled differently in various embodiments. In some embodiments, each zone 23 may be controlled to emit a specific hue, saturation, intensity, and CCT. In some embodiments, a user may specify a red light value, a green light value, a blue light value, and a CCT to be emitted by each zone 23. Additionally, either set of inputs (a specified hue, saturation, intensity, and CCT or a specified red light value, green light value, blue light value, and CCT) may be used in a Smart RGB mode to accurately create a specific color and CCT. The Smart RGB mode is described in detail below with reference to FIGS. 16 and 17.

Figure 8:
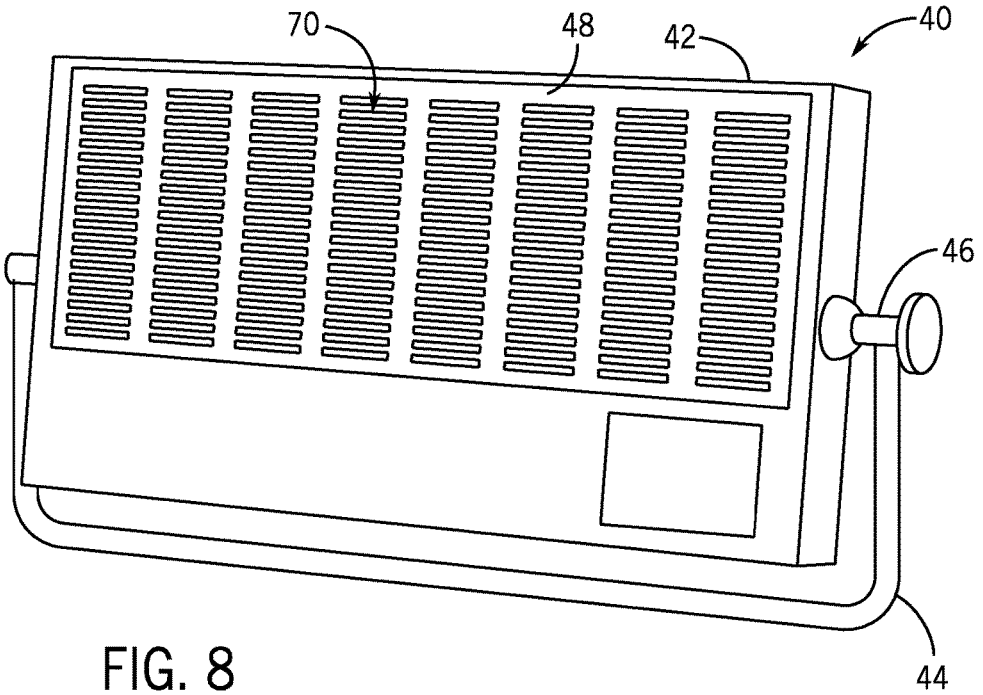
FIG. 8 is a perspective view of a lighting system, in accordance with current embodiments.

FIG. 8 is a perspective view of a lighting system 40 that may include color tunable zones. The lighting system 40 may include a lighting assembly 42, a support bar 44, and a swivel bar 46, such that the support bar 44 is configured to support the lighting assembly 42 and the swivel bar 46. In an exemplary embodiment, the swivel bar 46 may be rotatably coupled to the support bar 44 and may be rigidly coupled to the lighting assembly 42. In some embodiments, the swivel bar 46 may be rotatably coupled to the lighting assembly 42 and rigidly coupled to the support bar 44. Additionally, the swivel bar 46 may be rigidly coupled to both the lighting assembly 42 and the support bar 44.

As illustrated in FIG. 8, arrays of LED clusters 70 (visible through openings 48 of the lighting assembly 42) may be disposed in the lighting assembly 42 of the lighting system 40. As described above in relation to the lighting system 10, the arrays of LED clusters may be disposed on one or more PCB's and may be independently controlled to achieve various lighting effects.

Figure 9:
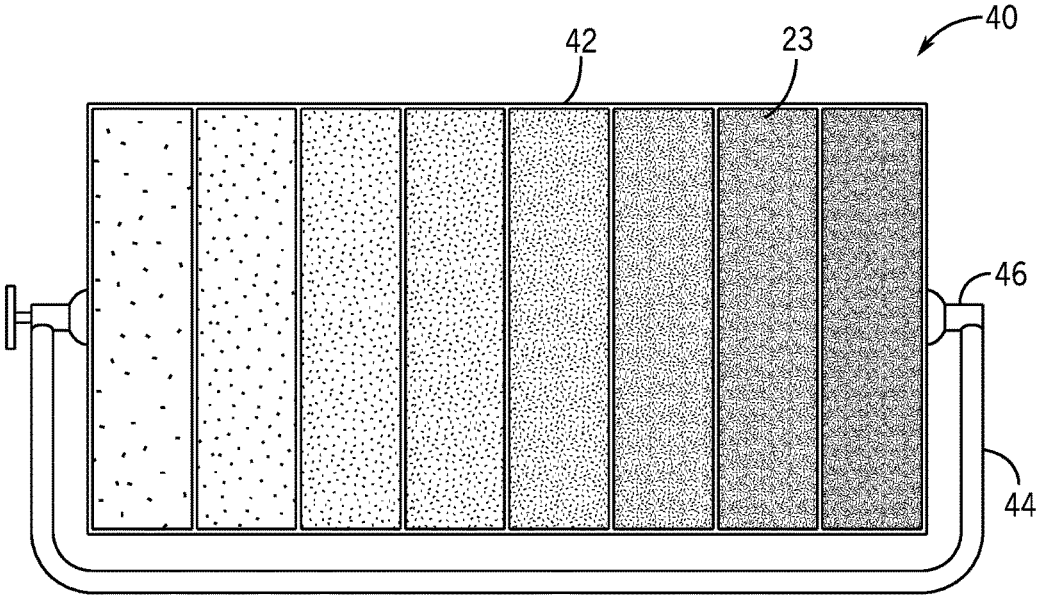
FIGS. 9 and 10 are exemplary arrangements of color tunable zones of the lighting system of FIG. 8, in accordance with current embodiments.

FIG. 9 is an exemplary arrangement of color tunable zones 23 of the lighting system 40 of FIG. 8. As illustrated, the zones 23 are disposed in a series along a face of the lighting assembly 42. Each zone 23 may be individually controlled to emit a particular color and CCT. One or more arrays of LED clusters 70 may be disposed on one or more PCB's at each zone 23. For example, a PCB with multiple arrays of LED clusters 70 may be disposed in the lighting assembly 42 at each zone 23. Additionally, each zone 23 may be dynamically adjusted to include more or less arrays of LED clusters 70.

Figure 10:
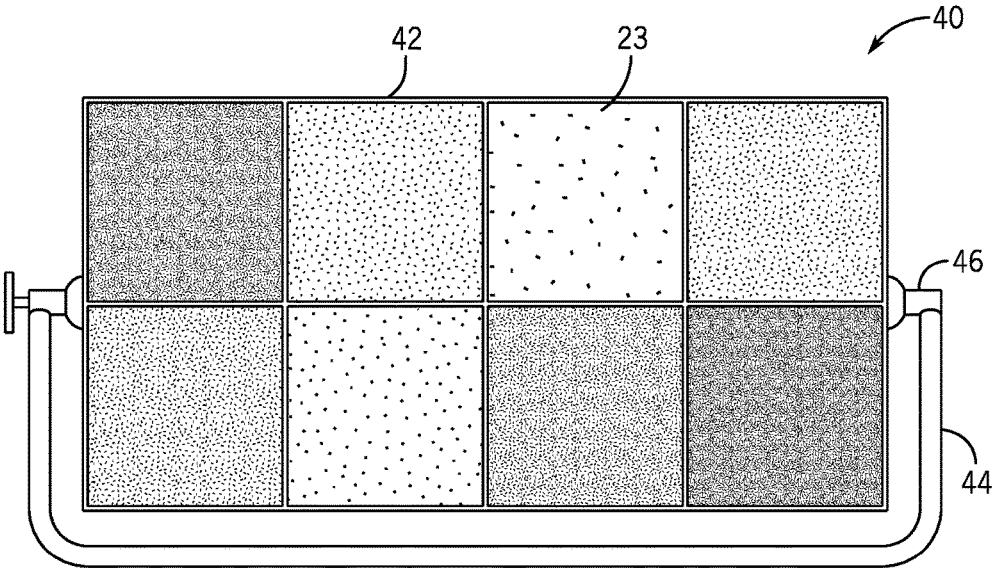

In some embodiments, the color tunable zones 23 may be arranged in a checkerboard pattern, as illustrated in FIG. 10. While the illustrated embodiments of FIGS. 9 and 10 each include 8 zones, more or less zones may be included in these types of zonal arrangements. Further, the zones 23 of the lighting system 40 may be dynamically adjusted from the zonal arrangement of FIG. 9 to the zonal arrangement of FIG. 10, and vice versa, with or without changing component hardware. Similar to the embodiment illustrated in FIG. 9, the zones 23 of FIG. 10 may also be configured to achieve various lighting effects.

Figure 11:
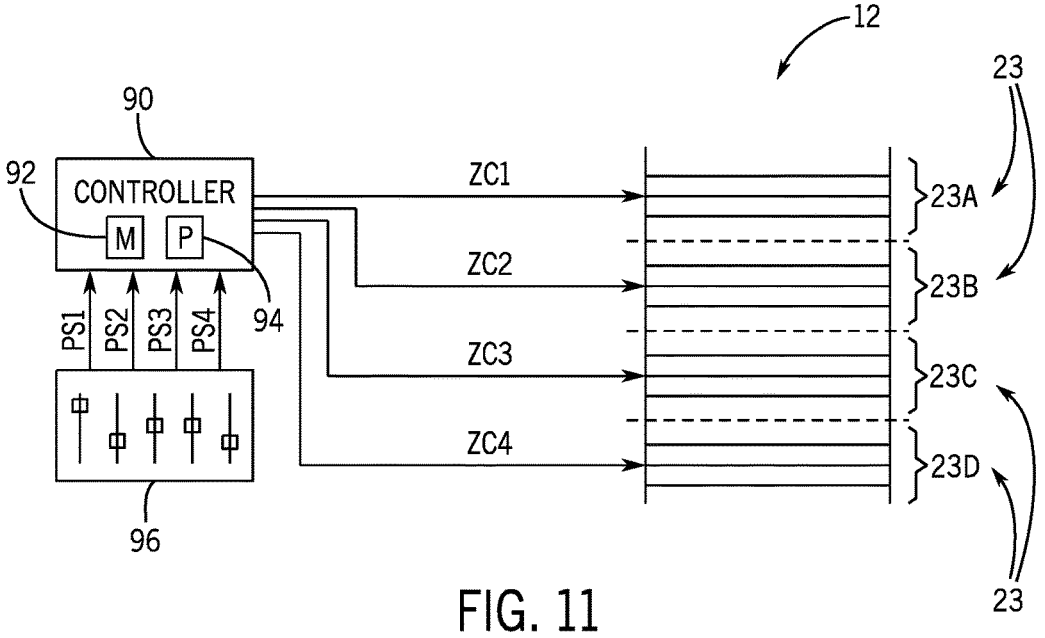
FIGS. 11 and 12 are schematics of a controller in communication with the lighting systems of FIGS. 1 and 8, in accordance with current embodiments.

FIG. 11 illustrates an example embodiment of a user interface 96 in communication with a controller 90, and the controller 90 in communication with the lighting assembly 12. The controller 90 is used to control individual zones 23 of the lighting assembly 12. Each zone 23 of FIG. 11 extends along a width of the lighting assembly 12. The controller 90 includes a memory 92 and a processor 94. In some embodiments, the memory 92 may include one or more tangible, non-transitory, computer-readable media that store instructions executable by the processor 94 and/or data to be processed by the processor 94. For example, the memory 92 may include random access memory (RAM), read only memory (ROM), rewritable non-volatile memory such as flash memory, hard drives, optical discs, and/or the like. Additionally, the processor 94 may include one or more general purpose microprocessors, one or more application specific processors (ASICs), one or more field programmable logic arrays (FPGAs), or any combination thereof.

The controller 90 may further communicate with the user interface 96 or input/output (I/O) devices that may facilitate communication between the controller 90 and a user (e.g., operator). The user interface 96 may include a button, a keyboard, a mouse, a trackpad, color-tuning controls, zonal lighting controls, and/or the like to enable user interaction with the controller 90. Additionally, the user interface 96 may include an electronic display to facilitate providing a visual representation of information, for example, via a graphical user interface (GUI), an application interface, text, a still image, and/or video content. The user interface 96 may be a lighting control interface (e.g., digital multiplex ("DMX"), Artnet, sACN, Kinet1). In some embodiments, the user interface 96 may be a component of the controller 90. A user may interact with the user interface 96 to input a particular control scheme of the zones 23 of the lighting system 10. One control scheme may include identifying a hue, saturation, intensity, and CCT value. Another control scheme may include identifying a CCT value and red, green, and blue light values. Each control scheme may use Smart RGB logic to more accurately control the lighting system 10.

Communication from the user interface 96 to the controller 90 may include one or more commands (e.g., DMX, an expanded version of DMX, RDM, or other suitable forms of commands) indicative of lighting effects for an independent zone based on user inputs. The one or more commands to and from the controller 90 may be protocol-specific. For example, in some embodiments, the user interface 96 may provide a first command or first set of commands, indicated by reference identifier PS1, to the controller 90. In some embodiments, each command or each set of commands (e.g., PS1, PS2, PS3, PS4) may be indicative of lighting effects including a hue, saturation, intensity, and CCT value for an independent zone 23. In some embodiments, each command or each set of commands may be indicative of a CCT value and red, green, and blue light values for an independent zone 23. For both methods of inputting desired lighting effects to the controller 90 (i.e., inputting a hue, saturation, intensity, and CCT value for an independent zone 23 or inputting a CCT value and red, green, and blue light values for an independent zone 23), each set of commands may include 4 commands such that 4 channels are used in communication between the user interface 96 and the controller 90. For example, 1 command may be used in each channel between the user interface 96 and the controller 90. In some embodiments, each zone 23 and/or each light tube 16 of the lighting system 10 may have a unique protocol-specific address (e.g., a unique DMX address) corresponding to a command or a set of commands. The unique protocol-specific address for each zone 23 may be defined such that the zone addresses are sequential and related to each zone's relative position in the lighting assembly 12. For example, zone 23A may have a unique DMX address of "1," zone 23B may have a unique DMX address of "2," zone 23C may have a unique DMX address of "3," and zone 23D may have a unique DMX address of "4." However, the individual DMX addresses may also be referred to by other numbers or other types of identifiers.

Communication to each zone 23 of the lighting assembly 12 from the controller 90 may be one or more zone control signals (e.g., ZC1, ZC2, ZC3, ZC4). The one or more zone control signals output to each zone 23 may be indicative of lighting effects indicated by a respective command received by the controller 90. For example, zone control signal ZC1 may be indicative of lighting effects indicated by PS1. In another example, there need not be one to one correspondence between zone control signals and commands received at the controller 90. In one example, two commands received at the controller 90 may correspond to one zone control signal. In another example, one command received at the controller 90 may correspond to two zone control signals. In the illustrated embodiment, the controller 90 sends the zone control signal ZC1 to a first zone 23A, the zone control signal ZC2 to a second zone 23B, the zone control signal ZC3 to a third zone 23C, and the zone control signal ZC4 to a fourth zone 23D. In other embodiments, the controller 90 may send more or less signals to each zone 23 of the lighting assembly 12 to control various parameters. In the illustrated embodiment of FIG. 11, each zone 23 spans a horizontal width of the lighting assembly 12. For example, in some embodiments, the controller 90 may send an independent command to each LED chip of each LED cluster with instructions to adjust a light value of the respective LED chip.

Figure 12:
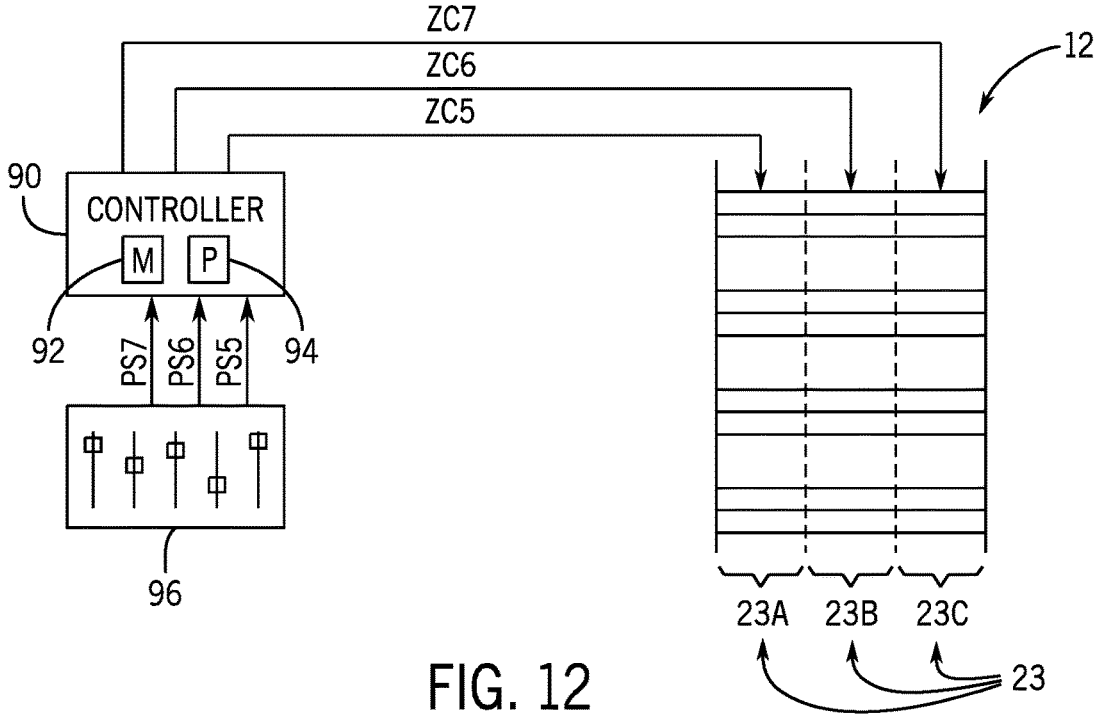

FIG. 12 illustrates another embodiment of the user interface 96 in communication with the controller 90, and the controller 90 in communication with the lighting assembly 12. In FIG. 12, the zones 23 extend along a length of the lighting assembly 12. The controller 90 receives commands or sets of commands PS5, PS6, and PS7 from the user interface 96. Similar to the one or more commands PS1, PS2, PS3, and PS4 described above, PS5, PS6, and PS7 may also be indicative of lighting effects for an independent zone 23. In the illustrated embodiment of FIG. 12, the controller 90 sends the zone control signal ZC5 to a first zone 23A, the zone control signal ZC6 to a second zone 23B, and the zone control signal ZC7 to a third zone 23C. Each zone 23 spans a vertical length of the lighting assembly 12. In FIGS. 11 and 12, the controller 90 is positioned to the left of the lighting assembly 12 and is illustrated as a single unit. However, the controller 90 may be positioned anywhere relative to the lighting assembly 12 and may be integral to the lighting assembly 12. Additionally, the controller 90 may be comprised of multiple units. Similar to the lighting system 40 of FIGS. 9 and 10, the lighting system 12 of FIGS. 11 and 12 may be dynamically adjusted from the horizontal zones of FIG. 11 to the vertical zones of FIG. 12, and vice versa. The lighting assembly 12 may also dynamically adjust to a checkerboard pattern of zones.

The use of DMX or similar commands may ensure that lighting transitions occur faster than individual frame transitions of a film. For example, the speed of an average video camera shutter is $1/24^{th}$ of a second or 42 milliseconds (e.g., 24 frames per second (FPS)). Therefore, an average video camera may capture an individual frame every 42 milliseconds. DMX communications may occur in 10 milliseconds or less. This enables lighting commands (e.g., DMX commands) to be performed in real time with transitions occurring faster than a single frame. Further, because LEDs are also high-speed devices, the lighting system 10 may create motion effects, as well as static displays of color, that are precisely synchronized with a video camera. For example, a 96 FPS camera may capture up to 4 lighting tracks at 24 FPS each in a single take such that each of the 4 lighting tracks exhibit different lighting scenarios. Each of the four lighting tracks may include a set of commands for controlling the lighting effects and transitions for one or more zones 23. Each zone 23, each zonal lighting device, and/or LED cluster 70 may be adjusted frame-by-frame to the desired lighting values. The adjustment of lighting values via commands may be synchronized with the instances in which a camera shutter is closed so that all captured frames have a specific set of desired lighting values. Various lighting effects (e.g., a simulated camera flash, a gunshot flash, lightning, and similar lighting patterns) may be achieved using this synchronized lighting approach.

Figure 13:
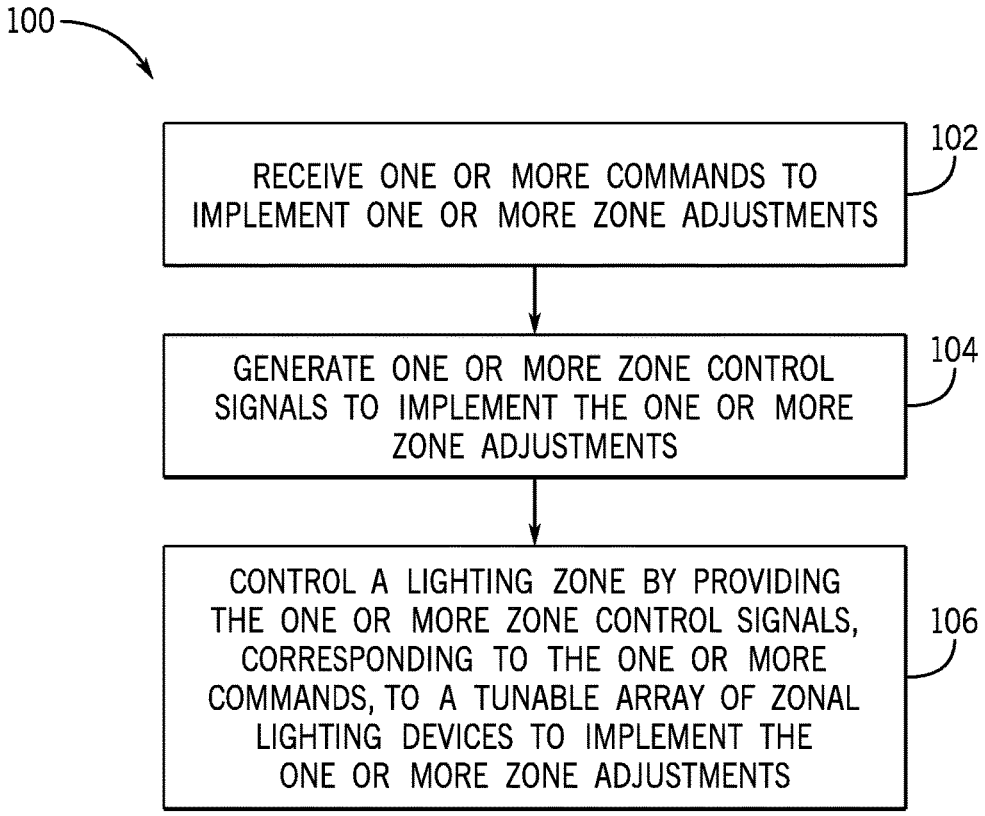
FIG. 13 is a flow diagram depicting the activity of a controller in an exemplary embodiment of the lighting systems of FIGS. 1 and 8, in accordance with current embodiments.

FIG. 13 is a flow diagram 100 depicting the activity of the controller 90 in an exemplary embodiment of the lighting system 10. As noted herein, a user may interact with the user interface 96 to input a particular set of desired lighting effects and/or zone adjustments of the zones 23 of the lighting system 10. In some embodiments, the desired effects or zone adjustments may include a particular hue, an intensity value, a saturation value, a white CCT value, or a combination thereof for each zone 23. In other embodiments, the desired effects or zone adjustments may include a white CCT value, a red light intensity value, a blue light intensity value, and a green light intensity value. The desired effects may also be a general setting that is input by a user to the user interface 96 (e.g., a user may input a setting for the lighting system 10 to simulate a particular shadow effect). Based on an input provided by the user to the user interface 96, the controller 90 will receive one or more commands indicative of the desired lighting effects and/or the adjustments to each zone 23 of the lighting system 10 that will achieve the desired lighting effects, as indicated by block 102.

At block 104, the controller 90 may determine and generate zone control signals to implement the zone adjustments for each zone 23. The controller 90 may refer to information stored in the memory 94 of the controller 90 to determine the particular adjustments that will be made to each zone 23 to achieve the desired effects. As described herein, the adjustments to each independent zone 23 may include adjusting the hue of a color, adjusting a color intensity, adjusting a color saturation, adjusting the percentage values output of a particular color, adjusting a CCT value for white light, and other similar adjustments. The adjustments to each zone 23 may also adjust the value of light emitted from each white LED chip, red LED chip, green LED chip, and blue LED chip in each LED cluster. In some embodiments, such adjustments to each LED chip may be determined by the controller 90 using the Smart RGB mode.

At block 106, after generating the zone control signals to implement the zone adjustments, the controller 90 may provide the zone control signals to each relevant zone 23 to allow for synchronized implementation at each zone 23. For example, a zone control signal may be provided to each LED chip of each LED cluster of each zone 23. In response to receiving the zone control signals, each LED cluster may adjust the color hue, the color intensity, the color saturation, the percentage values of particular colors, and/or a CCT value of white light to achieve the desired effects.

In some embodiments, the desired lighting effects may include the simulation of motion. The zones 23 of the lighting system 10 may simulate a cascade of motion from one portion of the lighting system 10 to another portion of the lighting system 10. This can simulate a moving shadow, a moving object, or moving light source. Examples of motion effects that may be simulated by the lighting system 10 include natural outdoor lighting effects (e.g., the sun, the moon, clouds, trees), car and transportation shadows (e.g., vehicle interior lights, vehicle headlights, street lights), lights of an interior or exterior of a building, green screen effects, color backdrops, backlit backgrounds, or a combination thereof. These motion effects can be achieved by illuminating backdrops, transparencies, direct lighting applications, and other applications with the lighting system 10. In some embodiments, the lighting effects may be preprogrammed or pre-scripted as sets of color value settings for each zone 23 of the lighting system 10. The sets of color values (e.g., a specified hue, saturation, intensity, and CCT or a specified red light value, green light value, blue light value, and CCT) may be pre-programmed to change at specific moments in time such that each zone 23 may be turned on and off sequentially to simulate various light motions.

For example, in filming, it may be desirable to simulate the motion of light in a sky (e.g., simulate light from an outdoor light source such as the sun). However, when the sun is out, clouds and other factors cause continual subtle shifts in the color and brightness of light. In particular, inconsistent natural lighting is common on partly cloudy days. The motion of lights in a sky may be simulated by the lighting system 10. Control of zones 23 of the lighting system 10 may mimic subtle, generally slow moving lighting effects, such as those that would simulate lights in a sky. Specifically, a first end of the lighting system 10 may appear brighter than a second end of the lighting system 10 at the beginning of a lighting sequence. As the lighting sequence progresses, the second end of the lighting system 10 may gradually appear brighter than the first end of the lighting system 10. This transition and change in light values of the lighting system 10 may mimic a light moving across a background (e.g., a light moving in a sky).

In another example, it may be desirable to simulate the lighting effects of a moving person, vehicle, train, or similar form of a moving object relative to one or more light sources, or vice versa (e.g., the shadows created by street lights in a vehicle interior as the vehicle is driven down a road). In these situations, lighting and shadows continually change. However, static lit car scenes using conventional green screen backgrounds can be very noticeable and unnatural looking. Control of the zones 23 of the lighting system 10 may simulate this object movement by emitting light of certain colors and intensities at certain times for individual zones 23. For example, the lighting system 10 may create the lighting effects of a vehicle or train entering or exiting a tunnel. To create such lighting effects, certain zone 23 of the lighting system 10 may be pre-programmed to gradually appear dimmer, to simulate entering a tunnel, or brighter, to simulate exiting a tunnel.

In some situations, filming includes the use of a green screen setting, which is edited during post-production processing. Actors are filmed in front of the green screen setting, and the green screen setting is replaced with a different background during post-production processing. The background may include active lighting changes. For example, a background may include motion, explosions, or other similar lighting effects. The lighting system 10 may be used to simulate such lighting effects. Additionally, both static color backdrops, as well as moving color backdrops, may be backlit using the lighting system 10. Rainbow effects, sequential color and brightness transitions, and similar lighting effects may also be created and controlled using the lighting system 10.

In some examples, filming includes large photographic murals that may be 15 feet high by 40 feet long or larger (e.g., murals that are ink jet printed on grand format printers). These photographic murals are often depictions of outdoor scenes in daylight or night. By using the lighting system 10 behind these still images it is possible to provide the illusion that they are more realistic and representative of a "real" outdoor scene. In a night scene, for example, the light provided by the lighting system 10 behind a dark sky may be decreased in intensity. In some scenes, the lighting provided by the lighting system 10 behind the illuminated city scape may be bright and/or more orange and warm. These lighting effects simulating outdoor scenes may be accomplished by controlling the zones 23 of the lighting system 10.

Additionally, in some embodiments, the lighting system 10 may simulate the reflection of a light source (e.g., the reflection from a television as a light source). For example, when filming a person or object in front of a TV or in a movie theater, the light hitting the person or object will change in color and intensity and slightly by direction. An actual TV or similar light source is too low power and has too little control for use as an effective light source to simulate light reflected from such a light source in motion picture or television filming. Using the zones 23 of the lighting system 10, the intensity and color of the light may be changed independently in each zone 23 to create a realistic lighting effect that varies in color and shadows that vary in incidence angle. Zonal lighting of the lighting system 10 may also be used to simulate similar light sources, such as light emitting signage.

Figure 14:
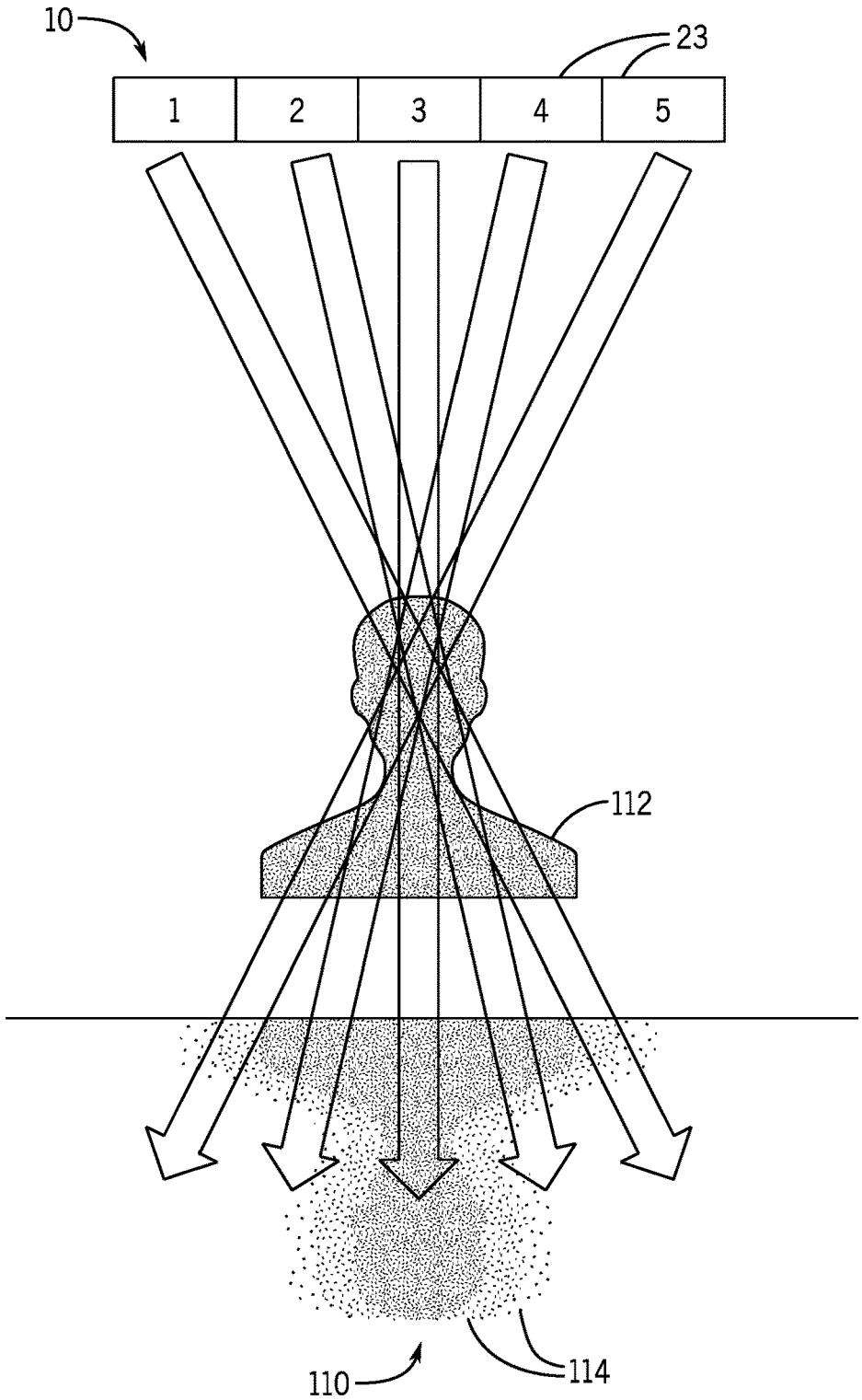
FIG. 14 is an illustration of chromatic aberrations that may be generated by the lighting systems of FIGS. 1 and 8, in accordance with current embodiments.

FIG. 14 is an illustration of chromatic aberrations 110 (i.e., variations in shadows) that may be generated by the lighting system 10 of FIGS. 1 and 8. In some lighting applications, adjustments are made to prevent chromatic aberrations, or chromatic aberrations are removed to create a sharper image of an object or person. In other lighting applications, it may be desirable to create chromatic aberrations for certain images and scenes. By controlling independent zones 23, chromatic aberrations 110 may be generated, which may include shadows and images that add complexity in in some applications. For example, shadows may include a slight chromatic halo effect through use of the lighting system 10, where the angle of incidence of the independent zones 23 of the lighting system 10 may be slightly different for each zone 23. The individual zones 23 may cast overlapping shadows with a variation in angle of incidence which may create chromatic aberrations 110 in the shadow. These chromatic aberrations 110 may be tuned and color selected using the zonal control features of the lighting system 10. In the illustrated embodiment of FIG. 14, chromatic aberrations 110 are created around the figure of a person 112. The chromatic aberrations 110 may include shadows 114. Each shadow 114 may vary in intensity such that a halo effect is created on and/or around the figure of a person 112.

Figure 15:
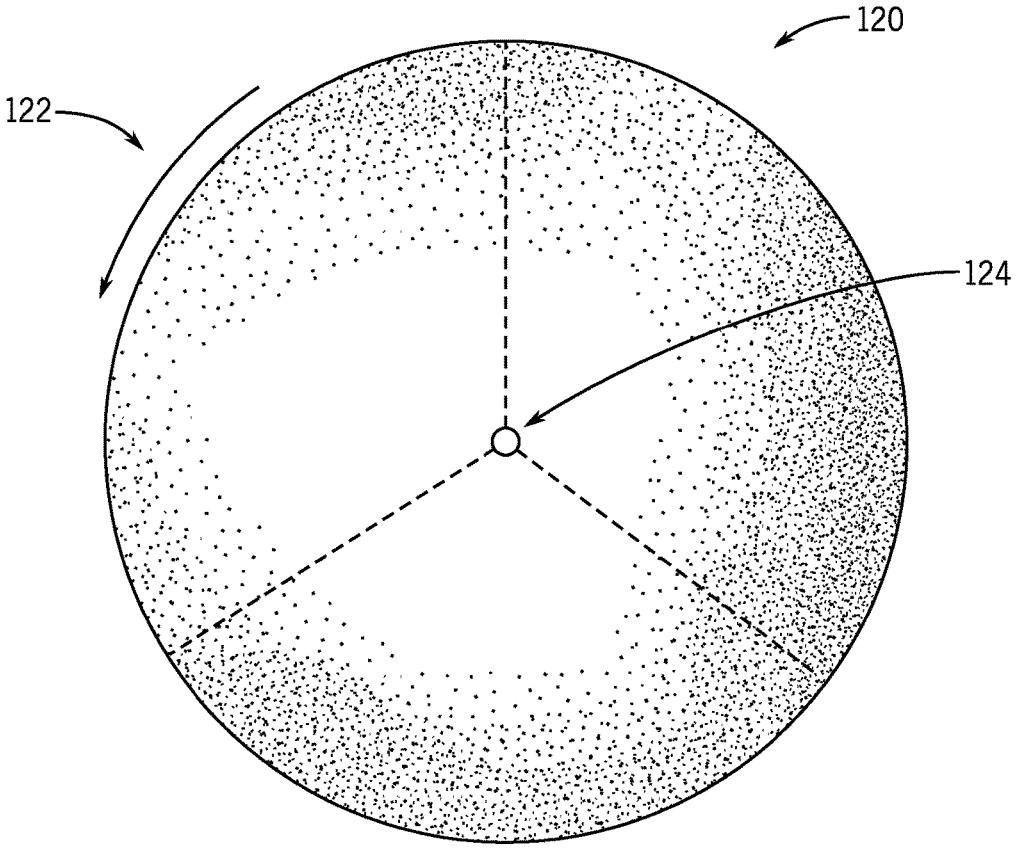
FIG. 15 is an illustration of a color chart indicating color values that may be specified for each zone of the lighting system of FIGS. 1 and 8, in accordance with current embodiments.

FIG. 15 is an illustration of a color chart 120 indicating red, blue, and green hue values that may be specified for each zone 23 of the lighting system 10. As previously described, each zone 23 and/or each light tube 16 of the lighting system 10 may have a unique protocol-specific address (e.g., a unique DMX address). In some embodiments, the addresses may be defined such that the zone addresses are sequential and related to each zone's position in the lighting assembly 12. The controller 90 may receive a command associated with a protocol-specific address from the user interface 96 indicative of the hue value for a particular zone 23. In the illustrated embodiment, the command from the user interface 96 to the controller 90 may include a hue value from 0 to 255, indicated by reference numeral 122, corresponding to the color of light to be added to a pure white light, indicated by arrow 124, which has an established CCT. As the arrow 124 moves inward toward a center of the color chart 120, the saturation (i.e., ratio of white light to colored light) may increase. The established CCT and intensity for white light may be included in a command sent from the user interface 96 to the controller 90. For example, in the illustrated embodiment, red has a hue value of 0 or 255, green has a hue value of 85, and blue has a hue value of 170. The command from the user interface 96 may specific one of these hue values or another hue value from 0 to 255. The hue value may be combined with the white light CCT and intensity to create the desired overall color and color saturation. In some embodiments, the controller 90 may send a zone-specific signal to each respective protocol-specific address of each zone 23 indicative of instructions to adjust both the hue value and the white light CCT value of the respective zone 23 based on the command from the user interface 96.

Figure 16:
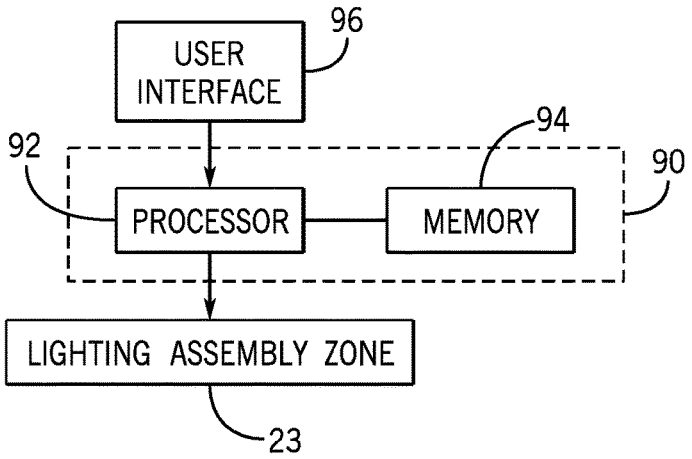
FIG. 16 is a schematic diagram depicting a process for Smart RGB control, in accordance with current embodiments.

FIG. 16 is a schematic diagram depicting lighting changes implemented using Smart RGB control. Each zone 23 of the lighting system 10 may be controlled to provide a desired color and CCT using Smart RGB control and logic. With Smart RBG control, the lighting system 10 may achieve more accurate colors and CCT's than traditional systems. For example, in the illustrated embodiment of FIG. 16, a controller, indicated by block 90, may include a processor 92 and a memory 94, and the controller 90 may be coupled to a user interface 96. The user interface 96 may receive an input from a user indicating desired effects and/or adjustments to a lighting system. The user interface 96 may then send a command to the processor 92 indicating the desired effects and/or the adjustments to be made to the lighting system. Based on this command, the processor 92 may use Smart RGB logic instructions stored in the memory 94 to determine the power values to be supplied to each LED chip of each LED cluster of each lighting assembly zone 23. After determining the power value to be supplied to each LED chip, the processor 92 may output one or more zone control signals to each lighting assembly zone 23 indicative of the power to be supplied to each LED chip. For example, the processor 92 may send a zone control signal to each zone, to each LED cluster, and/or to each individual LED chip. In response the signal from the processor 92, each LED chip may be supplied with the specified power, and each LED cluster may display the color and CCT that will achieve the desired effects and/or the adjustments to the lighting system input by the user. While the illustrated embodiment includes the use of Smart RGB control for zones 23 of the lighting system, Smart RGB control may also be used in other applications. For example, Smart RGB control may be used monochrome settings (i.e., settings with a single color and CCT).

Figure 17:
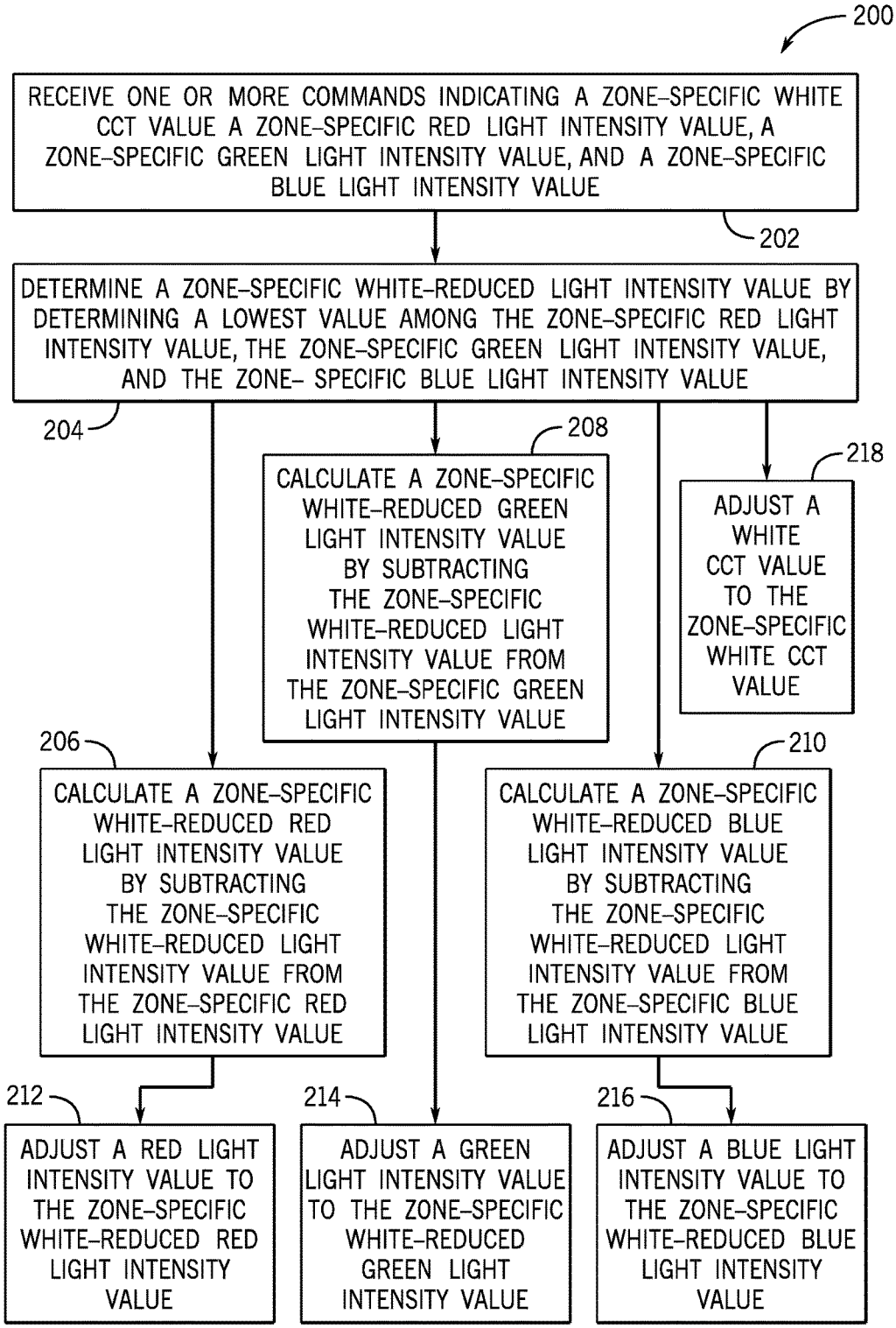
FIG. 17 is a flow diagram depicting the logic for Smart RGB control, in accordance with current embodiments.

FIG. 17 is a flow diagram 200 depicting the logic of Smart RGB control. As described above, Smart RGB logic may be used to achieve accurate colors and CCT's emitted by LED chips. In an exemplary embodiment, each LED cluster includes two white LED chips with base CCT values of 2700 K and 6500 K, a red LED chip, a green LED chip, and a blue LED chip. At block 202, the controller 90 may receive one or more commands (or signals) indicative of a zone-specific red light value, a zone-specific green light value, a zone-specific blue light intensity value, and a zone-specific white CCT value, from a user. At block 204, the controller 90 may determine a zone-specific white-reduced light intensity value. The zone-specific white-reduced light intensity value may correspond to the amount of pure white light intensity to be emitted by white LED chips in an LED cluster. The controller 90 may determine the zone-specific white-reduced light intensity value based on a minimum value of the zone-specific red light value, the zone-specific green light value, and the zone-specific blue light intensity value. This zone-specific white-reduced light intensity value may then be subtracted from the zone-specific red light value, the zone-specific green light value, and the zone-specific blue light intensity value that were input by the user to determine the amount of red light, green light, and blue light (indicated by blocks 206, 208, and 210, respectively) to be emitted by a red LED chip, a green LED chip, and a blue LED chip, respectively, in each LED cluster. After determining the various intensities, the controller 90 may output zone control signals indicative of instructions to adjust a white output to match the zone-specific white-reduced light intensity value, and adjust a red output, green output, and blue output to match the zone-specific white-reduced red light intensity value, the zone-specific white-reduced green light intensity value, and the zone-specific white-reduced blue light intensity value, respectively. For example, at block 212, the controller 90 may output a zone control signal to adjust a red light intensity value to the zone-specific white-reduced red light intensity value. The controller 90 may perform similar functions for the green light intensity value (block 214), the blue light intensity value (block 216), and the white CCT value (block 218).

To better describe the logic of Smart RGB control, an example is provided with reference to FIG. 17. A user may specific that, for a given situation, the desired lighting settings include a zone-specific 50% intensity value for red light, a zone-specific 65% intensity value for green light, a zone-specific 95% intensity value for blue light, and a zone-specific CCT of 3200 Kelvin ("K"). At block 202, the controller 90 may receive one or more commands indicative of these values. At block 204, the controller 90 may determine the zone-specific white-reduced light intensity value as 50%, because 50% is the minimum intensity value of the zone-specific red light value, the zone-specific green light value, and the zone-specific blue light intensity value initially input by the user. The controller may then determine the zone-specific white-reduced red light intensity value to be emitted by a red LED chip as 0% by subtracting the zone-specific white-reduced light intensity value (50%) from the zone-specific red light value (50%), as indicated by block 206. The controller may determine the zone-specific white-reduced green light intensity value to be emitted by a green LED chip as 15% by subtracting the zone-specific white-reduced light intensity value (50%) from the zone-specific green light value (65%), as indicated by block 208. The controller may determine the zone-specific white-reduced blue light intensity value to be emitted by a blue LED chip as 45% by subtracting the zone-specific white-reduced light intensity value (50%) from the zone-specific blue light intensity value (95%), as indicated by block 210. After determining the zone-specific white-reduced light intensity value, the zone-specific white-reduced red light intensity value, the zone-specific white-reduced green light intensity value, and the zone-specific white-reduced blue light intensity value to be emitted by each respective LED chip of each LED cluster, the controller 90 may zone control signals to each LED chip cluster 70, each zone 23, and/or each zonal lighting device indicating each respective value.

In the present example, the controller 90 would output a signal indicative of instructions to two white LED chips in each LED cluster for the specified zone to create a white light of 3200 K at 50% intensity. The 2700 K white LED chip and 6500 K white LED chip would each emit an amount of light that will generate a CCT of 3200 K for that LED cluster at an intensity of 50%. The controller 90 would output a signal indicative of instructions to a red LED chip in each LED cluster for the specified zone to create a red light at 0% intensity. The controller 90 would output a signal indicative of instructions to a green LED chip in each LED cluster for the specified zone to create a green light at 15% intensity. The controller 90 would output a signal indicative of instructions to a blue LED chip in each LED cluster for the specified zone to create a blue light at 45% intensity. The controller 90 may perform these logic blocks for each zone and each set of received inputs from the user. The white-reduced color values, along with the specified white CCT value, that are determined using Smart RGB logic allow for a more accurate portrayal of lighting effects compared to traditional lighting systems.

As may be appreciated, the current systems and techniques provide significant enhancements to studio lighting systems. For example, additional lighting effects may be executed by lighting systems that include spatially related zones that can be addressed by independent lighting commands. Further, enhanced color and white light values may be executed by the lighting system using Smart RGB logic and independent LED clusters.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lighting system, comprising:

a tunable array of zonal lighting devices providing a plurality of lighting zones, wherein each zonal lighting device corresponds to an independent lighting zone and each zonal lighting device is configured for independent color control and independent white color correlated temperature (CCT) control; and a controller configured to:

receive one or more commands to implement one or more zone adjustments, wherein the one or more commands comprise:

an indication of the independent lighting zone of the plurality of lighting zones to adjust; and an indication of a zone-specific white CCT value independent from one or more color values, wherein the zone-specific white CCT value corresponds to a CCT value of a camera sensor; and control the plurality of lighting zones by providing one or more zone control signals, corresponding to the one or more commands, to the tunable array of zonal lighting devices to implement the one or more zone adjustments.

2. The lighting system of claim 1, wherein each zonal lighting device comprises a plurality of light-emitting diode (LED) clusters distributed linearly across each zonal light device, and wherein each LED cluster comprises at least two different white LEDs, one or more red LEDs, one or more green LEDs, and one or more blue LEDs.

3. The lighting system of claim 1, wherein the one or more zone adjustments implement a lighting effect associated with one or more objects, wherein the lighting effect comprises a simulated motion of a first object in the presence of the one or more objects, or vice versa, and wherein the one or more objects comprise a natural outdoor light, vehicle headlights, a building light, a street light, or a combination thereof.

4. The lighting system of claim 1, wherein the one or more commands are received from a user interface, and wherein the one or more commands indicate the zone-specific white CCT value, a zone-specific red light intensity value, a zone-specific green light intensity value, and a zone-specific blue light intensity value.

5. The lighting system of claim 4, wherein the controller is configured to provide the one or more zone control signals based on RGB logic by determining a zone-specific white-reduced light intensity value based on the zone-specific red light intensity value, the zone-specific green light intensity value, and the zone-specific blue light intensity value.

6. The lighting system of claim 5, wherein the controller is further configured to determine the zone-specific white-reduced light intensity value by determining a lowest value among the zone-specific red light intensity value, the zone-specific green light intensity value, and the zone-specific blue light intensity value, and wherein the lowest value corresponds to the zone-specific white-reduced light intensity value.

7. The lighting system of claim 6, wherein the controller is further configured to provide the one or more zone control signals based on the RGB logic by:

calculating a zone-specific white-reduced red light intensity value by subtracting the zone-specific white-reduced light intensity value from the zone-specific red light intensity value;

calculating a zone-specific white-reduced green light intensity value by subtracting the zone-specific white-reduced light intensity value from the zone-specific green light intensity value; and calculating a zone-specific white-reduced blue light intensity value by subtracting the zone-specific white-reduced light intensity value from the zone-specific blue light intensity value.

8. The lighting system of claim 7, wherein the one or more zone control signals provided based on the RGB logic comprises:

a first signal based on the calculated zone-specific white-reduced red light intensity value;

a second signal based on the calculated zone-specific white-reduced green light intensity value;

a third signal based on the calculated zone-specific white-reduced blue light intensity value; and a fourth signal based on the zone-specific white-reduced light intensity value.

9. A non-transitory computer readable medium comprising code to:

receive one or more commands to implement one or more zone adjustments to a lighting system, wherein the lighting system comprises a tunable array of zonal lighting devices providing a plurality of lighting zones, wherein each zonal lighting device corresponds to an independent lighting zone and each zonal lighting device is configured for independent color control and independent white color correlated temperature (CCT) control, and wherein the one or more commands comprise:

an indication of an independent lighting zone of the plurality of lighting zones to adjust; and an indication of a zone-specific white CCT value independent from one or more color values, wherein the zone-specific white CCT value corresponds to a CCT value of a camera sensor; and control the plurality of lighting zones by providing one or more zone control signals, corresponding to the one or more commands, to the tunable array of zonal lighting devices to implement the one or more zone adjustments.

10. The non-transitory computer readable medium of claim 9, wherein the one or more commands are received from a user interface, and wherein the one or more commands indicate the zone-specific white CCT value, a zone-specific red light intensity value, a zone-specific green light intensity value, and a zone-specific blue light intensity value.

11. The non-transitory computer readable medium of claim 10, further comprising code to provide the one or more zone control signals based on RGB logic by determining a zone-specific white-reduced light intensity value based on the zone-specific red light intensity value, the zone-specific green light intensity value, and the zone-specific blue light intensity value.

12. The non-transitory computer readable medium of claim 11, further comprising code to determine the zone-specific white-reduced light intensity value by determining a lowest value among the zone-specific red light intensity value, the zone-specific green light intensity value, and the zone-specific blue light intensity value, and wherein the lowest value corresponds to the zone-specific white-reduced light intensity value.

13. The non-transitory computer readable medium of claim 12, wherein the code to provide the one or more zone control signals based on the RGB logic comprises code to:

calculating a zone-specific white-reduced red light intensity value by subtracting the zone-specific white-reduced light intensity value from the zone-specific red light intensity value;

calculating a zone-specific white-reduced green light intensity value by subtracting the zone-specific white-reduced light intensity value from the zone-specific green light intensity value; and calculating a zone-specific white-reduced blue light intensity value by subtracting the zone-specific white-reduced light intensity value from the zone-specific blue light intensity value.

14. The non-transitory computer readable medium of claim 13, wherein the one or more zone control signals provided based on the RGB logic comprises:

a first signal based on the calculated zone-specific white-reduced red light intensity value;

a second signal based on the calculated zone-specific white-reduced green light intensity value;

a third signal based on the calculated zone-specific white-reduced blue light intensity value; and a fourth signal based on the zone-specific white-reduced light intensity value.

15. A lighting method, comprising:

receiving one or more commands to implement one or more zone adjustments of a lighting system, wherein the lighting system comprises a tunable array of zonal lighting devices providing a plurality of lighting zones, wherein each zonal lighting device corresponds to an independent lighting zone and each zonal lighting device is configured for independent color control and independent white color correlated temperature (CCT) control, and wherein the one or more commands comprise:

an indication of the independent lighting zone of the plurality of lighting zones to adjust; and an indication of a zone-specific white CCT value independent from one or more color values, wherein the zone-specific white CCT value corresponds to a CCT value of a camera sensor; and implementing the one or more zone adjustments by controlling the plurality of lighting zones of the tunable array of zonal lighting devices.

16. The lighting method of claim 15, wherein implementing the one or more zone adjustments of the lighting system comprises identifying the zone-specific white CCT value, a zone-specific red light intensity value, a zone-specific green light intensity value, and a zone-specific blue light intensity value.

17. The lighting method of claim 16, further comprising determining a zone-specific white-reduced light intensity value based on the zone-specific red light intensity value, the zone-specific green light intensity value, and the zone-specific blue light intensity value.

18. The lighting method of claim 17, wherein determining the zone-specific white-reduced light intensity value comprises determining a lowest value among the zone-specific red light intensity value, the zone-specific green light intensity value, and the zone-specific blue light intensity value, and wherein the lowest value corresponds to the zone-specific white-reduced light intensity value.

19. The lighting method of claim 18, further comprising:

calculating a zone-specific white-reduced red light intensity value by subtracting the zone-specific white-reduced light intensity value from the zone-specific red light intensity value;

calculating a zone-specific white-reduced green light intensity value by subtracting the zone-specific white-reduced light intensity value from the zone-specific green light intensity value; and calculating a zone-specific white-reduced blue light intensity value by subtracting the zone-specific white-reduced light intensity value from the zone-specific blue light intensity value.

20. The lighting method of claim 19, wherein implementing the one or more zone adjustments comprises:

adjusting a red light intensity value to the zone-specific white-reduced red light intensity value;

adjusting a green light intensity value to the zone-specific white-reduced green light intensity value;

adjusting a blue light intensity value to the zone-specific white-reduced blue light intensity value; and adjusting a white CCT value to the zone-specific white CCT value.

* * * * *